United States Patent [19]

Kuntzsch

[11] 4,006,653

[45] Feb. 8, 1977

[54] LAMP INSERTING AND EXTRACTING TOOL

[75] Inventor: Donald W. Kuntzsch, West Allis, Wis.

[73] Assignee: Allen-Bradley Company, Milwaukee, Wis.

[22] Filed: Sept. 22, 1975

[21] Appl. No.: 615,870

[52] U.S. Cl. ..... 81/64

[51] Int. Cl.[2] ..... B25B 13/52

[58] Field of Search ..... 81/64, 3.43, 125; 294/20, 21, 33

[56] References Cited

UNITED STATES PATENTS

| | | | |
|---|---|---|---|
| 2,701,491 | 2/1955 | Ross | 81/64 |
| 2,743,640 | 5/1956 | Verkuil | 81/64 |
| 2,956,462 | 10/1960 | Paul | 81/64 UX |
| 3,473,423 | 10/1969 | Peck | 81/64 |
| 3,678,789 | 7/1972 | Wilson | 81/64 |

*Primary Examiner*—James L. Jones, Jr.
*Attorney, Agent, or Firm*—Arnold J. Ericsen

[57] ABSTRACT

A tool for inserting and extracting small objects such as lamp bulbs from relatively inaccessible areas. The tool comprises a single molded plastic member having cup-like portions at opposite ends. One cup is resilient and frictionally grips the object for removal, whereas the opposed cup is relieved by means of a radial slot to permit temporary retention of the object while it is being inserted and to freely release the object after it has been inserted.

6 Claims, 8 Drawing Figures

LAMP INSERTING AND EXTRACTING TOOL

BACKGROUND OF THE INVENTION

This invention relates to a means for inserting and extracting object, such as miniature lamp bulbs, from relatively inaccessible areas, such as recessed lamp sockets in pushbuttons, keys, indicators or the like.

It will be appreciated that in recent years, there has been increasing tendency to miniaturize electrical devices requiring miniature lamps. As the lamps have become smaller, it also has been convenient to place the lamp socket assembly in relatively inaccessible recessed areas. Obviously, this often presents difficulty in removal and insertion of the recessed lamp or similar object. Initial attempts to solve this problem led to the use of so-called "spaghetti" insulation tubes, which are normally used to contain and protect electrical conductors. The inner diameter of the tubing was of a size that would permit frictional gripping of the elongated lamp bulb. It will be apparent that, although this was a satisfactory means for removing a lamp bulb, it was virtually impossible to use the same means for inserting the lamp bulb, because the tubing would be difficult to remove from the lamp after it was inserted. Later efforts to correct this problem involved the provision of a flexible tubing which was also stretchable to accommodate various size lamps for the removal of the lamp. At the opposite end of the tubing there was provided a relatively small "suction cup" portion which would be attached to the outermost end of the lamp bulb and would temporarily hold the lamp for insertion purposes. In order to remove the suction cup, the tool would have to be canted to the side to break the suction. It will become apparent that if the socket for the lamp bulb was recessed to any degree within a relatively deep, narrow chamber, there would be insufficient spacing to permit sidewise movement for removal of the tool after insertion of the lamp.

Several lamp or similar object extracting and injecting tools have been the subject of U.S. patents. See, for instance, the patents granted to Masland — U.S. Pat. No. 2,251,148; Oliveri — U.S. Pat. No. 2,607,620; Wagstaff — U.S. Pat. No. 2,924,481; Adams — U.S. Pat. No. 3,284,123 and Peck — U.S. Pat. No. 3,473,423. Of these listed patents, tools specifically intended for extraction and insertion of lamps, or like objects, in recessed places are those shown in the Oliveri, Wagstaff and Peck patents. In addition, reference is also made of the IBM Technical Disclosure Bulletin, Volume 6, Number 10, Mar. 10, 1964, page 9, wherein G. H. Mack also disclosed a bulb changing tool used for purposes similar to those of the present invention. The tools of Wagstaff, Oliveri and Mack (IBM) each have means for disengaging the tool from the object gripped after insertion of the object. The means in each of these cases is in the form of an axially movable plunger contained within a hollow chamber of an elongated housing member. Pressure applied against the plunger after insertion of the object in its receptacle permitted contact with the object by the plunger to release the frictional or pneumatic grip of the lamp by the tool. It will be apparent that these tools have several cooperating parts requiring additional forming and assembly operations to fabricate a finished tool.

The Adams patent is illustrative of a somewhat similar tool, wherein the "plunger" is an intricately molded member centrally located within the hollow bore of a resiliently formed tool. The Masland patent merely discloses a means for applying a frictional grip for removing "frozen" lamp bulbs from a head-light fixture of an automobile, whereas the Peck patent is quite similar to the Masland construction, but additionally includes a wire brush for cleaning the socket before inserting the tool.

Further illustrations of lamp removing devices may be found in the U.S. Pat. No. 2,545,043 granted to Odenthal and U.S. Pat. No. 2,681,822 granted to Daniels.

SUMMARY OF THE INVENTION

The present invention relates to a tool for inserting and extracting lamp bulbs, or the like, from relatively inaccessible areas. The tool of the preferred embodiment is of unitary, molded plastic construction, including integrally formed cup-like portions disposed at opposite ends of an enlongated support member. One of the cup-like portions is of a dimension which permits frictional purchase or gripping of an object such as a lamp for removal of the lamp from its receptacle. In its preferred form, the cup-like portion is arranged with three relatively flat internal wall surfaces which intimately engage the lamp, and which wall surfaces join intermediate curved surfaces of a dimension suitable to permit expulsion of entrapped air in the cup-like portion as it is being fitted on the lamp. This permits a frictional grasp of a maximum axial depth of the lamp.

The oppositely disposed cup-like portion is preferably annular and of sufficient depth to receive a suitable length of a lamp bulb or like object. In this case, the preferred embodiment includes at least one longitudinal slot extending substantially coextensive with the depth of the cup-like portion. The lamp bulb is inserted and temporarily retained in the cup-like portion and is frictionally gripped during insertion thereof in its receptacle. It will be apparent that the frictional grasp is substantially less than that of the cup-like portion used for removing the lamp. Here, it is desired to provide relatively easy removal of the tool from the lamp after lamp has been inserted in its socket or other receptacle. The slot, or preferably diametrically opposed slots, permits a minimal amount of sidewise motion to allow the tool to be removed from the lamp after insertion.

It will be apparent that the tool of the present invention provides, among its various objects, an inexpensive, unitary construction adaptable for use in both removal and installation of lamp bulbs, or the like, in relatively inaccessible areas, and particularly areas which are fairly deeply recessed. The various disadvantages concerning economy of manufacture, fabrication and assembly of the aforementioned prior art devices are avoided by the unitary single-piece plastic molding.

The foregoing and other objects and advantages of the invention will appear in the following drawing which forms a part hereof and shows by way of illustration a preferred embodiment of the invention. Such embodiment does not necessarily represent the full scope of the invention, and reference is made to the claims herein for interpreting the breadth of the invention.

DESCRIPTION OF THE PREFERRED EMBODIMENT

Figure 1:
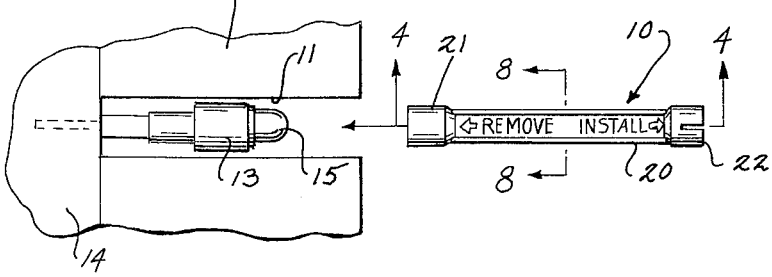
FIG. 1 is a frontal view, in elevation, of a preferred embodiment of the tool of the present invention and a fragmentary view of a device including a recessed lamp, and illustrating the disposition of a lamp in a relatively inaccessible area.
Figure 3:
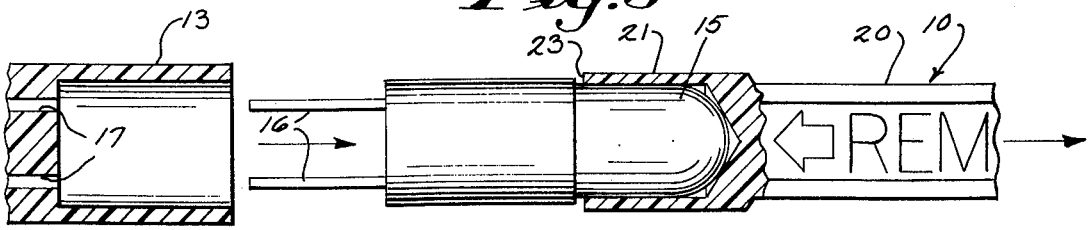
FIG. 3 is an exploded view, partially in section and partially fragmental, illustrating the lamp being removed from its receptacle by means of the tool.

With reference to FIG. 1, it will be observed that the tool of the present invention, indicated generally by the reference numeral 10, is preferably elongated and of suitable length to be inserted inwardly of a chamber 11 of a device, such as an illuminated pushbutton, key, or indicator 12 having a receptacle or socket 13 seated in a base 14. In the present application, it will be noted that the lamp bulb 15 (see FIG. 3) is of the type that has two inwardly extending prong-like terminals 16 extending from the lamp bulb 15 and arranged to be slidable received in the apertures 17 of the receptacle or socket 13.

Figure 5:
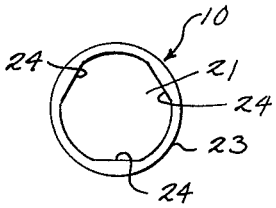
FIG. 5 is an end plan view of the tool of FIG. 1 taken along lines 5—5 of FIG. 4.
Figure 2:
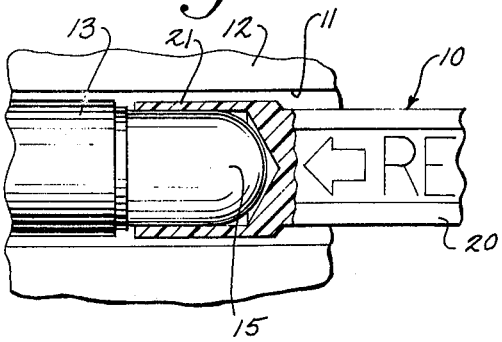
FIG. 2 is an enlarged fragmentary, elevational view, partly in section, of the tool of the present invention as applied directly to a lamp preparatory to removal of the lamp from its socket or receptacle.
Figure 4:
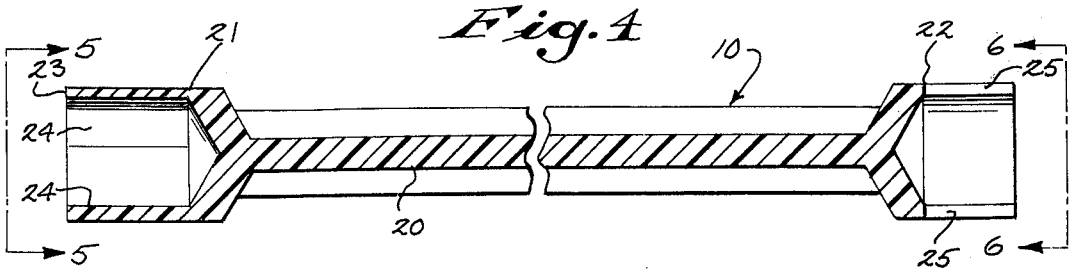
FIG. 4 is an enlarged longitudinal sectional view of the tool of the present invention taken along lines 4—4 of FIG. 1.

It will be observed from FIGS. 1 and 4 that the tool of the present invention is preferably of a single-piece molding. A preferred embodiment is molded of polypropylene theremoplastic molding compound. The single-piece molding comprises an elongated support or holder 20 having integrally molded therewith oppositely disposed, resilient, cup-like portions or members 21 and 22. The lamp removal cup 21 will first be described with reference to FIGS. 1–5, inclusive. The cup 21 is of sufficient depth to provide a suitable purchase, or grip, on the lamp bulb 15. It will be observed from FIG. 5 that the wall 23 is relatively thin to provide the resiliency needed for slightly expanding the cup 21 for frictionally receiving the lamp bulb 15. It is also desirable to provide at least one flat surface 24 internally of the cup-like member 21 as a means of permitting entrapped air to be expelled as the cup is being fitted over the bulb 15. This provides a means of reducing the relative axial length of the cup 21, since without the means for expelling air, some means such as an extended chamber (not shown), would have to be provided to collect the entrapped air as the cup is fitted over the bulb. There are conceivably other means for permitting the expulsion of air, such as providing a small pinhole formed in the side of the cup (not shown). The disadvantage of such pinhole in the preferred embodiment would be that the single molding feature might require complicated retractable molding pin assemblies in the dies used in forming the tool 10. It will be further observed that the relatively thin resilient wall 23 is of a minimal dimension, such that it may be received in a chamber 11 providing a minimum space between the chamber and the lamp bulb 15.

When it is desired to remove the lamp 15 from its socket 13, the tool is manually moved to receive the lamp 15 within the confines of the cup-like member 21. The frictional purchase or grasp by the cup 21 will permit direct axial movement of the tool for removing the lamp bulb 15 from its receptacle 13.

Figure 6:
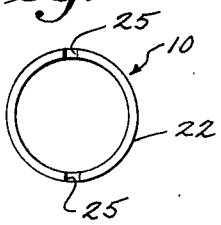
FIG. 6 is an end plan view of the tool of FIG. 1 taken along lines 6—6 of FIG. 4.

Installation of the replacement lamp bulb 15 is accomplished with the opposite cup-like member 22, which is also arranged to receive the lamp bulb 15. However, in this case, it will be apparent that there should not only be sufficient support for the lamp bulb 15, but in addition the cup 22 must be relatively easy to remove from the lamp bulb 15 after the lamp has been seated in its socket or receptacle 13. This is accomplished with particular reference to FIGS. 4, 6 and 7. It will be observed that the installation cup-like portion 22 is slotted at 25. The slots 25 may be molded simultaneously with the forming of the tool. Either one or more of the slots 25 permit release of the bulb 15 from the tool after the bulb 15 is inserted in its receptable 13. An axial withdrawal of the tool 10 from the bulb 15, with minimal twisting or sidewise motion, is all that is required for release after insertion of the bulb 15 in its receptable 13.

Figure 7:
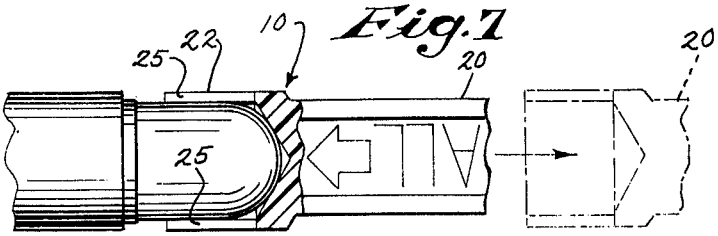
FIG. 7 is an enlarged frontal elevational view, partially in section and partially in fragment, illustrating the tool of the present invention used for inserting a lamp in its receptacle and thereafter removing the tool from the lamp.

That is, the cup-like portion 22 merely acts as a temporary retainer for purposes of installing a lamp bulb 15, as shown in FIG. 7 and removing the tool 10 from the lamp bulb 15 after insertion, as shown in the dotted portion of FIG. 7.

Figure 8:
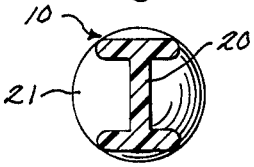
FIG. 8 is a cross-sectional view of the tool of the present invention taken along lines 8—8 of FIG. 1.

It will also be noted that the tool holder or support 20, as shown in FIGS. 4 and 8, is preferably formed to provide the H-shaped cross-section, as a means of saving material without sacrificing significant strength.

I claim:

1. A tool for inserting in and extracting from a relatively inaccessible area a miniature lamp bulb, or the like, arranged for insertion and extraction in a direction paralleling the longitudinal axis of the lamp bulb and comprising:

a support;

a resilient, removal cup member disposed at one end of said support and adapted for receiving and frictionally engaging said bulb, whereby said bulb may be gripped for removal from said area, said removal cup member including means for releasing entrapped air during receipt of said lamp bulb;

a resilient installation cup member disposed at the opposite end of said support and with its defining wall surface being relieved to permit relatively loose receipt and temporary retention of said bulb, whereby said tool may be freely released from said bulb after said bulb has been positioned in said area.

2. The tool of claim 1, wherein said support is elongated and of sufficient length for extracting and inserting said bulb in said area when said area is recessed in a surrounding chamber, and wherein said cup members are each defined by a relatively thin wall of a thickness less than the space between said lamp bulb and said chamber.

3. The tool of claim 1, wherein said tool comprises a single piece molding including said support and integral molded cup members disposed at opposite ends of said support.

4. The tool of claim 1, wherein the said removal cup member is of general annular cross-section substantially coextensive of its length, and wherein the means for releasing entrapped air includes a relatively flat area formed internally and extending axially relative to said removal cup.

5. The tool of claim 4, wherein the inner wall surface of said cup member includes three circumferentially spaced flat areas for releasing entrapped air.

6. The tool of claim 1, wherein the installation cup is the sole support for temporary retention of said lamp bulb and the wall surface of the installation cup member is relieved by means of at least one longitudinal slot form in the surface and extending inwardly from the open end of the cup.

* * * * *